US006109405A

United States Patent [19]

Odachi et al.

[11] Patent Number: 6,109,405

[45] Date of Patent: Aug. 29, 2000

[54] NON-CONTACTING POWER SUPPLY SYSTEM FOR RAIL-GUIDED VEHICLE

[75] Inventors: Yasuharu Odachi; Masaki Takasan; Yoichi Saito, all of Aichi, Japan

[73] Assignee: Kabushiki Kaisha Toyoda Jidoshokki Seisakusho, Kariya, Japan

[21] Appl. No.: 09/174,285

[22] Filed: Oct. 16, 1998

[30] Foreign Application Priority Data

Oct. 17, 1997 [JP] Japan ..... 9-284844

[51] Int. Cl.[7] ..... B61L 3/00

[52] U.S. Cl. ..... 191/10

[58] Field of Search ..... 191/10, 2, 3, 5, 191/6; 310/12, 13; 307/18, 43

[56] References Cited

U.S. PATENT DOCUMENTS 5,938,151 8/1999 Takasan et al. ..... 191/10

FOREIGN PATENT DOCUMENTS 8-168195 6/1996 Japan .

9-93841 4/1997 Japan .

9-298801 11/1997 Japan .

*Primary Examiner*—Mark T. Le

*Attorney, Agent, or Firm*—Morgan & Finnegan, L.L.P.

[57] ABSTRACT

In a non-contacting power supply system for a rail-guided vehicle which can move along a plurality of power supply lines connected to respective power sources and receive a supply of electric power required for moving from the plurality of power supply lines, the rail-guided vehicle comprises a plurality of power receiving cores for receiving a supply of electric power from the plurality of power supply lines. The gaps between the plurality of power supply lines in the portions between the power supply lines are set to be equal to or longer than the length of each of the power receiving cores in the direction of the power supply lines, thereby eliminating the bad influence on the non-contacting power supply system due to the difference between the phases or frequencies of the power sources of the power supply lines.

4 Claims, 5 Drawing Sheets

NON-CONTACTING POWER SUPPLY SYSTEM FOR RAIL-GUIDED VEHICLE

BACKGROUND OF THE INVENTION

1. Title of the Invention

The present invention relates to a non-contacting power supply system for a rail-guided vehicle, and more particularly to a non-contacting power supply system for supplying electric power to a rail-guided vehicle which moves along a plurality of power supply lines having respective power sources.

2. Description of the Related Art

Conventionally, a non-contacting power supply system for a rail-guided vehicle is frequently arranged by using a power supply line having a maximum length of 100 meters, with a single power source.

However, the demand for arranging a non-contacting power supply system having a longer power supply line, such as a 300-meter line, 500-meter line, etc. has been increasing in recent years, which leads to the use of a plurality of power sources. This is because a single power source has a supply limit.

In the case of an arrangement of a long power supply line, the power supply line is divided into a plurality of sublines, to each of which a power supply unit is connected. The ends of the plurality of sublines are arranged to be as close as possible in consideration of safety, deviation, a temperature change, etc., so as to prevent a power supply from stopping or decreasing to a low level in the portion between two power supply lines.

The frequencies and phases of the power supply units for the plurality of sublines are controlled to be almost the same. If the frequencies and phases of two power supply units are exactly the same, a rail-guided vehicle can properly pass through the portion between the sublines.

Provided below is the explanation about the relationship between the portion between conventional power supply lines and a power receiving core, by referring to FIG. 1.

A power receiving core 1 is wound with an electric wire (a winding 7 to be described later), which receives induced electric power from a power supply line and supplies the received power to the drive system of a rail-guided vehicle.

Power supply lines 2 and 3 are sublines into which one line is divided, and are respectively connected to power supply units 4 and 5.

The power supply units 4 and 5 are units which can output an alternating current with a large power capacity at a high frequency.

A rectifying element 6 is an AC/DC converting element for converting the high frequency electric power, which is received by the power receiving core 1, into a direct current, and for supplying the DC power to the drive system of the rail-guided vehicle.

The winding 7 is a winding for generating electric power by being oriented in the direction which is most susceptible to the electric power from the magnetic flux in the magnetic field generated in both the power supply lines 2 and 3 and by being positioned as near as possible to the portion where the magnetic flux is the strongest.

If the frequencies and phases of the power supply units 4 and 5 for both of the divided power supply lines 2 and 3 are exactly the same and are fully synchronized, electric power can be supplied in the portion obtained by subtracting the length L1 from L2 in the power receiving core 1, although the supplied electric power decreases in the gap L1 between the power supply lines 2 and 3, when the rail-guided vehicle passes between the power supply lines 2 and 3. Therefore, the rail-guided vehicle can properly pass through the portion between the power supply lines 2 and 3.

However, since a power supply line to which a single power supply unit can supply electric power is approximately 100 meters long, the wiring for connecting a plurality of power supply units which are intended to have synchronized phases, can be expected to be longer. Additionally, the device for synchronizing the phases of the plurality of power supply units is newly required, which leads to troublesomeness. Accordingly, a plurality of conventional power supply units do not perform such a process for making the frequencies and phases exactly the same.

Additionally, even if the frequencies of the plurality of power supply units are respectively set to be the same, the actual frequencies may slightly differ from one another due to the differences in operation of the PLLs of the respective power supply units. Because the timing at which the waveforms are outputted from the respective power supply units differ, the phases of the respective power supply units may differ.

When the rail-guided vehicle tries to pass through the portion between power supply lines under such conditions that the frequencies and the phases are different, a beat tone occurs in the supplied electric power due to the difference between the frequencies of the corresponding power supply units. Since the frequency of the beat is much lower than that of the power source, it is approximate to a direct current. Accordingly, the loss of the power source rapidly increases, and an overcurrent occurs inside the power source, so that a protection circuit will operate, a switching element will be destroyed, or the power supply units will become uncontrollable. If there is a difference between the power capacities of the power supply units, the power supply unit with a smaller power capacity will become uncontrollable. If there is almost no difference, both of the power supply units may sometimes become uncontrollable.

If the frequencies are exactly the same, a phase lag only increases the maximum amplitude of an output. However, if the above described beat occurs, the maximum amplitude of the beat will be increased.

SUMMARY OF THE INVENTION

An object of the present invention is to provide a non-contacting power supply system which has no bad influence on power supply units due to a beat, etc. when a rail-guided vehicle passes through the portion between power supply lines, for a rail-guided vehicle which can move along a plurality of power supply lines connected to respective power sources, and receive the supply of electric power required for moving from the plurality of power supply lines.

Namely, the length in the direction of the power supply lines of each of a plurality of power receiving cores attached to the flatcar for receiving the supply of electric power from the power supply lines, is made equal to or longer than the gaps between the plurality of power supply lines in the portions between the plurality of power supply lines, thereby eliminating the case where two primary windings (power supply lines) with different frequencies and phases exist for a single secondary winding of the rail-guided vehicle, thereby having no bad influence on a non-contacting power supply system due to a difference between the phases and frequencies of the power sources of the plurality of power supply lines.

Additionally, a rectifying element is arranged for each power receiving core. Accordingly, even if the frequencies and phases of the electric power supplied to power receiving cores are different, the received electric powers are converted into DC power by the rectifying elements and added. As a result, the electric power can be supplied to the drive system without being influenced by a difference in the frequency or the phase of the AC power in the portions between the plurality of power supply lines.

Furthermore, when one of a plurality of power receiving cores according to the present invention passes through the portions between a plurality of power supply lines, the decrease from the total supplied power by the amount of power that this receiving core receives, that is, the ratio at which the total voltage decreases, can be lowered by increasing the number of power receiving cores.

DESCRIPTION OF THE PREFERRED EMBODIMENTS

Figure 1:
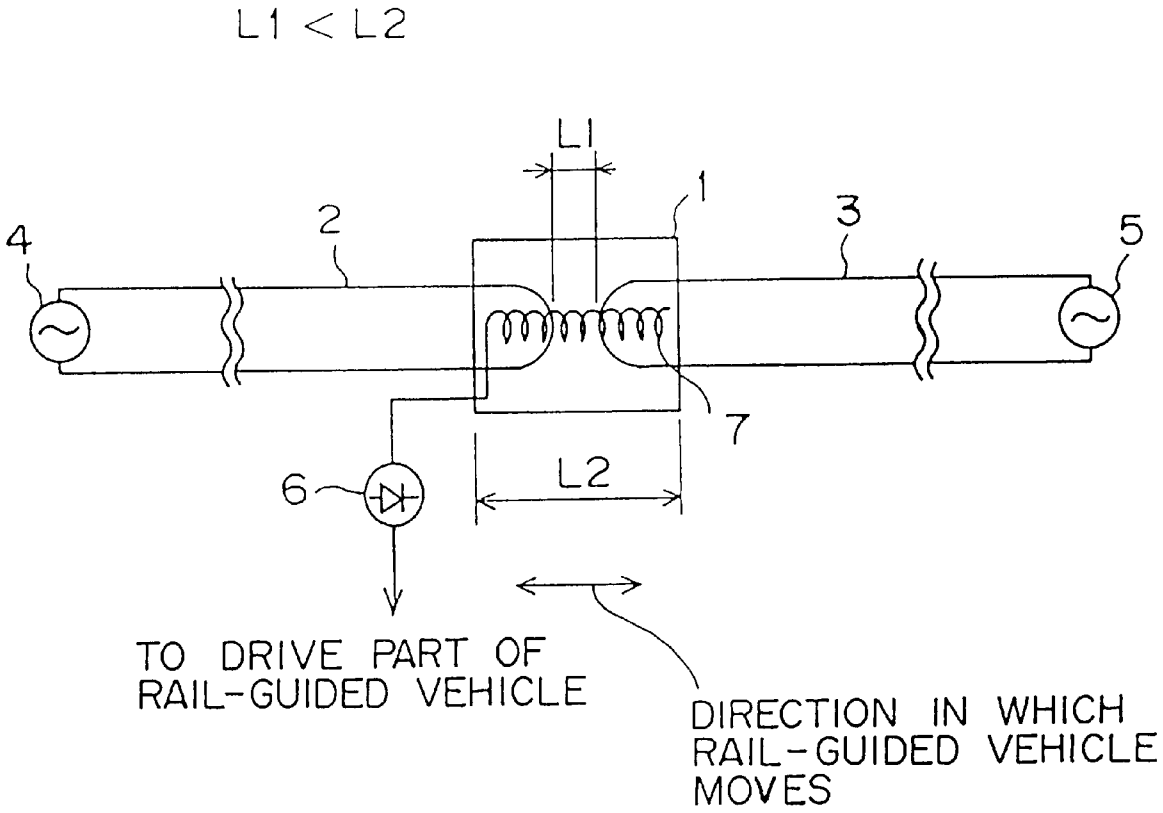
FIG. 1 (PRIOR ART)
FIG. 1 shows the relationship between a gap L1 between power supply lines and the length L2 of a conventional power receiving core.

Provided below is the explanation about preferred embodiments according to the present invention, by referring to the drawings.

Figure 2:
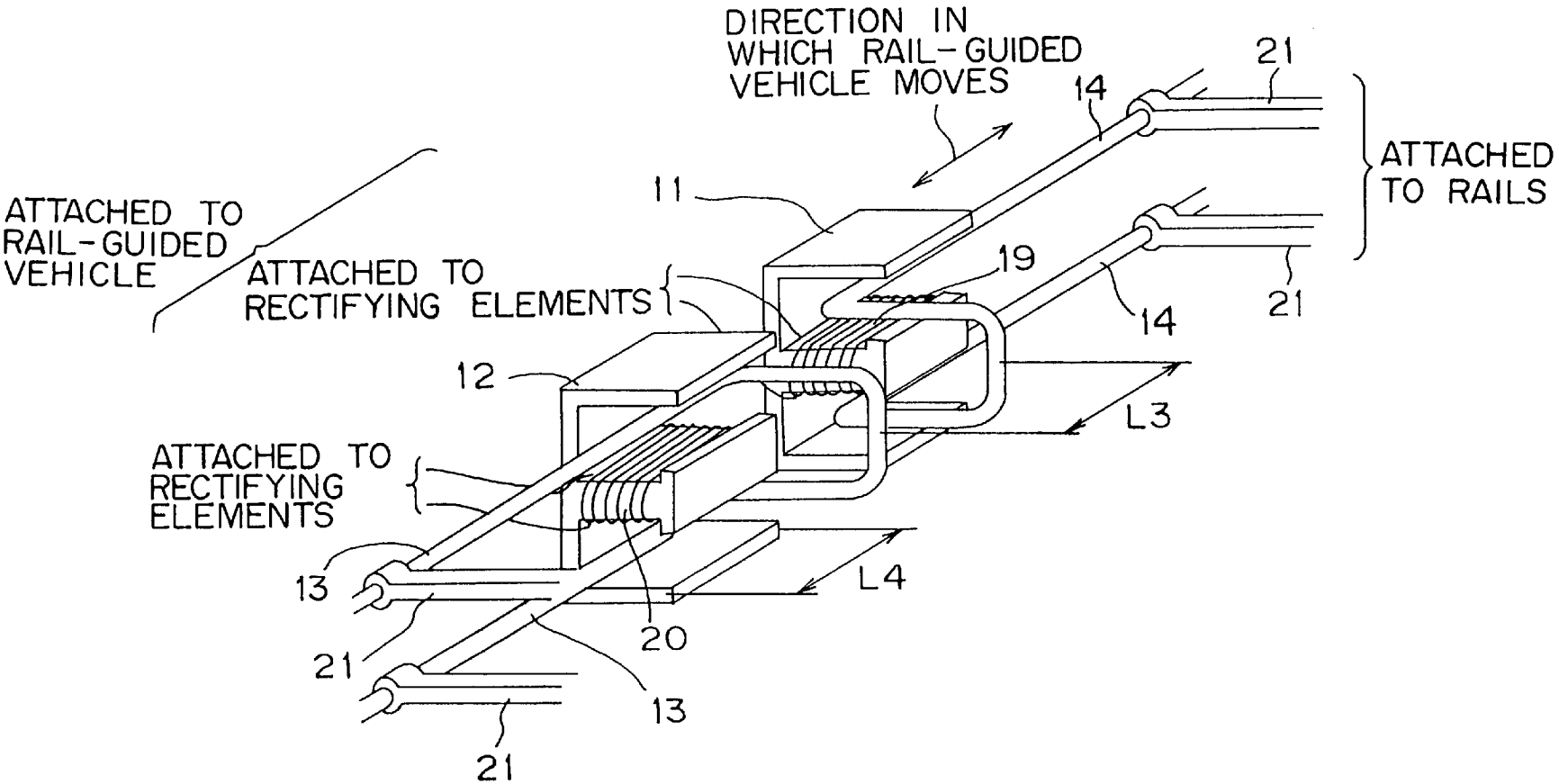
FIG. 2 is a perspective view showing a first preferred embodiment according to the present invention.

FIG. 2 is a perspective view showing a non-contacting power supply system for a rail-guided vehicle, according to a first preferred embodiment of the present invention.

Power receiving cores 11 and 12 are formed of ferrite, or by assembling a plurality of silicon steel plates which have superior high frequency characteristics. The cores are in the shape of the English character "E" viewed from the direction where the power supply lines, to be described later, are arranged. The outside of the vertical bar of the character "E" is attached to the rail-guided vehicle. Each of the power receiving cores 11 and 12 is attached to the flatcar so that power supply lines 13 and 14, which will be described later, are inserted as near as possible into the middle of the portions between the top and intermediate horizontal bars and between the intermediate and bottom horizontal bars of the character "E", respectively. Additionally, each of secondary coils 19 and 20, which will be described later, is formed by winding an electric wire for picking up electric power, around the intermediate horizontal bar of the character "E" of each of the power receiving cores 11 and 12.

Each of the power supply lines 13 and 14 is formed of litz wire having a total length of 100 meters at most, etc., and is connected to a power supply unit, not shown. The frequency of the electric power supplied to each of the power supply lines 13 and 14 is approximately 10 KHz, in contrast to the frequency of the electric power for normal commercial use of 50/60 Hz. The current supplied to the power lines is approximately 100 Amps. The power supply lines 13 and 14 are attached to rails, not shown, by supports 21, to be described later, so that the respective distances between the power supply lines 13 and between the power supply lines 14 become identical. The ends of the power supply lines 13 and 14 where they loop back are formed to ensure the power receiving cores 11 and 12 can pass through unobstructed, as shown in FIG. 2. Each of the power supply lines (13 and 14) is fixed to the rails by the supports 21 at regular intervals.

The power supply lines 13 and 14 generate a magnetic flux around them when an electric power is supplied. Therefore, if the rails, not shown, are made of metal such as aluminum, etc, the power supply lines 13 and 14 are arranged so that they are as far as possible from the rails by using the supports 21, to be described later, in order to prevent an overcurrent from occurring.

Each of the secondary coils 19 and 20 is a coil formed by electric wire wound around the intermediate horizontal bar of the character "E" of each of the power receiving cores 11 and 12, and is intended to pick up electric power. A Teflon coating, which is superior in insulation, heat-proof, and is abrasion-proof even if it is thin, is used on the electric wire used for the coil in order to increase the number of times that the wire is wound around the power receiving core.

The surfaces of the windings of the secondary coils 19 and 20 wound with Teflon coated wire are further bound with insulation tape, etc. in order to be protected from contacting the power supply lines 13 and 14, although this is not shown in this figure.

The outputs of the secondary coils 19 and 20 are connected to the rectifying elements for the respective coils, which are not shown in this figure.

Each of the supports 21 is a support for securing the distance between the power supply lines 13 or 14, and for fixing each of the power supply lines to each of the rails, not shown, by securing the distance between each of the rails and each of the power supply lines 13 and 14. The supports are formed of a macromolecular insulating material such as engineering plastic, etc. in order not to be influenced by the magnetic flux of the power supply lines 13 and 14.

In the portion between the power supply lines 13 and 14, a support, not shown, whose shape is similar to that of the support 21, is used in order to secure the distance L3 between the power supply lines 13 and 14.

At this time, the distance between the power supply lines 13 and 14 is fixed by the supports 21, etc. so that the gap L3 between the power supply lines 13 and 14 is longer by several centimeters than the length L4 of each of the power receiving cores 11 and 12 in the direction of the power supply lines 13 and 14.

If the portion L3 is much longer than L4, it extends the state where no power is supplied to the power receiving cores 11 and 12 of a rail-guided vehicle when it passes through the gap between the power supply lines 13 and 14, as shown in FIG. 2. Accordingly,it is desirable that the length L3 is as short as possible in order to stably drive the rail-guided vehicle. However, L3 cannot be made shorter than the length L4 of each of the power receiving cores 11 and 12, in order to avoid the state where two power sources individually supply electric power to each of the power receiving cores 11 and 12. Although the gap L3 may be equal to or longer than the length L4, the gap L3 is set to be longer than L4 by several centimeters in consideration of the size difference between the respective cores, the difference between the thickness of the windings of each of the cores, and the size of the windings, etc.

Figure 3:
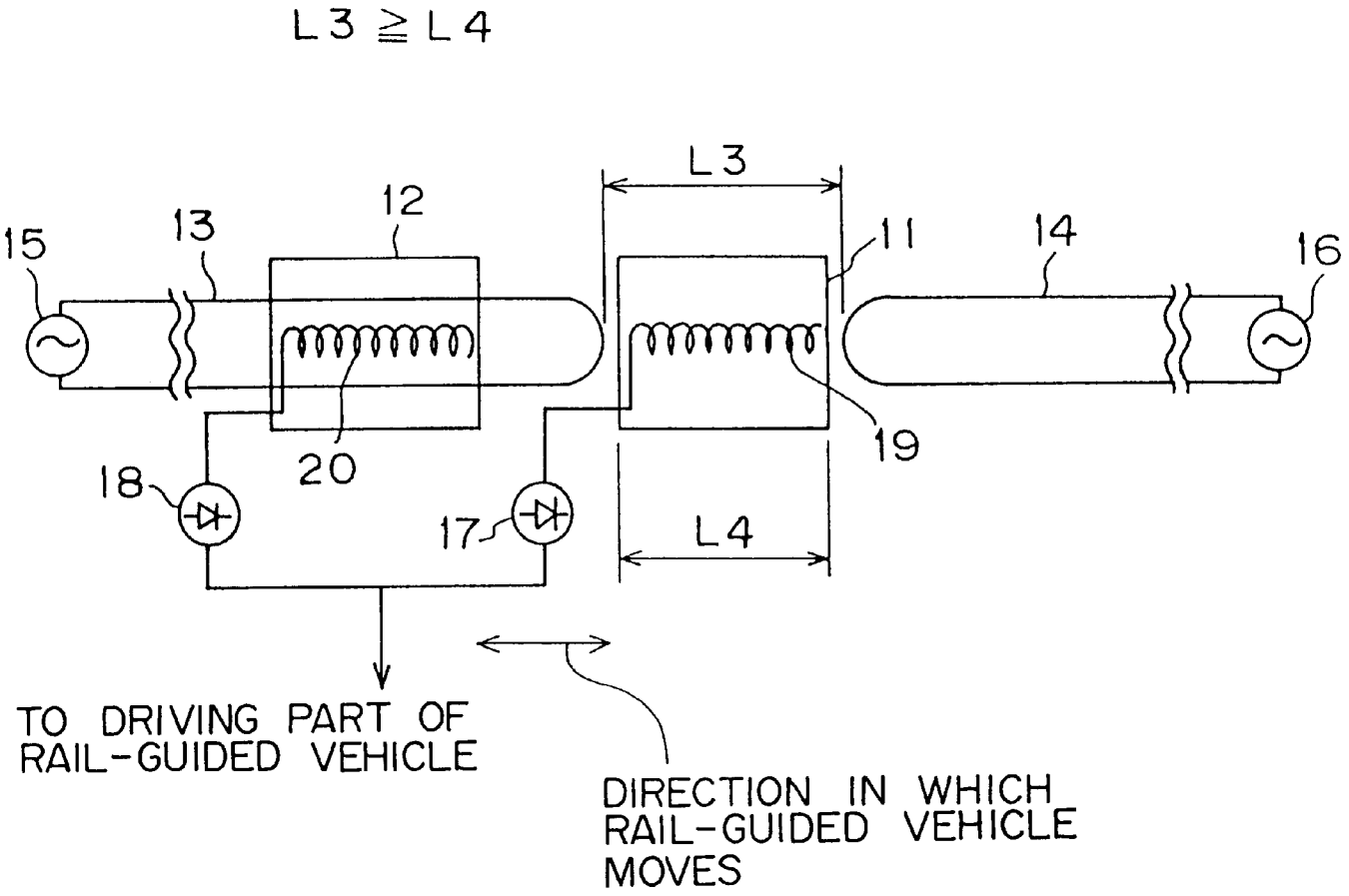
FIG. 3 shows the relationship between the gap L3 between the power supply lines in the first preferred embodiment shown in FIG. 1, and the length L4 of a power receiving core.

FIG. 3 shows the relationship between the gap L3 between the power supply lines 13 and 14, and the length L4, in the direction of the power supply lines 13 and 14, of the power receiving core 11 (or the power receiving core 12), which is difficult to compare in the perspective view of the first preferred embodiment shown in FIG. 2.

The sizes of the power receiving cores 11 and 12 are equal, and the interval between the power receiving cores 11 and 12 may be arbitrarily set. However, it is desirable that the interval between the power receiving cores 11 and 12 is longer than the gap L3 in order to prevent the state where the total voltage is low.

Power supply units 15 and 16 are respectively connected to the power supply lines 13 and 14. The output frequencies of both of the power supply units 15 and 16 can be changed by an inverter, etc., and may be adjusted and made constant by a PLL, etc. Assume that the output frequencies of both of the power supply units 15 and 16 are set to 10 KHz. In the power receiving cores 11 and 12, the secondary coils 19 and 20 are arranged in the direction where the magnetic flux of each of the power supply lines 13 and 14 is easiest to be obtained and in the neighborhood of the location where the magnetic flux is the strongest (the orientation of the secondary coils shown in FIG. 2 is an orientation for the sake of the convenience of illustration.)

The electric power obtained by each of the secondary coils 19 and 20 is rectified into direct current by respective rectifying elements 17 and 18, and both of the DC electric powers are added and supplied to the driving part of a rail-guided vehicle.

The gap L3 implemented in this preferred embodiment has a value which is slightly larger than the value of the length L4 (by several centimeters) as described above. Assuming that the rail-guided vehicle moves from the left to the right in FIG. 3, the maximum electric power is initially received when the total length of the power receiving core 11 is within the power supply lines 13. As the power receiving core 11 to which the electric power is supplied moves into the gap L3, the amount of received power decreases. When the power receiving core 11 is completely within the gap L3, it enters the state where no electric power is received for the time it is between the power supply lines 13 and 14. Then, the power receiving core 11 starts to pass through the power supply lines 14, and begins to gradually receive the electric power from the power supply lines 14. Finally, when the power receiving core 11 is fully within the power supply lines 14, it receives the maximum electric power from the power supply lines 14.

Similarly, after the power receiving core 12 receives the maximum electric power from the power supply lines 13, the amount of power received by the power receiving core 12 gradually decreases as the power receiving core 12 approaches the portion between the power supply lines 13 and 14 while the rail-guided vehicle is moving. The power receiving core 12 then enters the state where no electric power is received. Then, the amount of power received from the power supply lines 14 gradually increases. Finally, also the power receiving core 12 receives the maximum electric power from the power supply lines 14.

If the interval between the power receiving cores 11 and 12 is set to be longer than the gap L3 for the rail-guided vehicle, the electric power received from the power supply lines 13 in the power receiving core 12 begins to decrease only after the maximum electric power can be received by the power receiving core 11 from the power supply lines 14. Therefore, the combined voltages of the power receiving cores 11 and 12 do not become two low.

If the interval between the power receiving cores 11 and 12 is shorter than the gap L3, the voltages from both of the power receiving cores 11 and 12 may become low at the same time when crossing between power supply lines 13 and 14. However, the total amount of the electric power received by both of the power receiving cores 11 and 12 does not become smaller than that in the case where either of the power receiving cores 11 and 12 enters the state where no power is received, namely half of the maximum power. Therefore, if the case where either of the power receiving cores 11 and 12 enters the state where no power is received is considered as the time at which the total amount of received power is the smallest.

Figure 4:
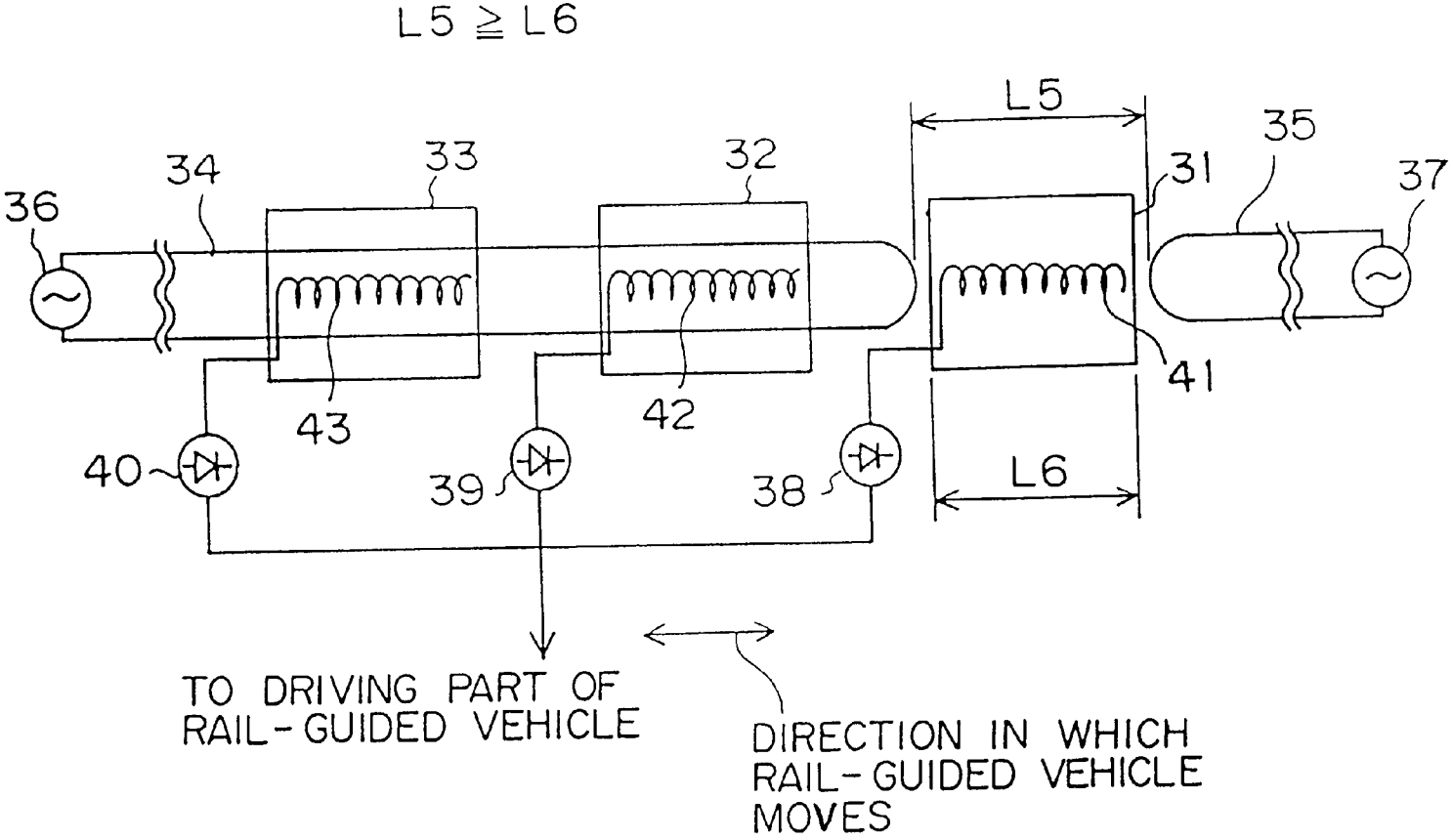
FIG. 4 shows the relationship between a gap L5 between power supply lines and the length L6 of a power receiving core, according to a second preferred embodiment of the present invention.

FIG. 4 shows a second preferred embodiment where the number of power receiving cores 11 and 12 in the first preferred embodiment shown in FIG. 3 is increased from 2 to 3.

Power receiving cores 31, 32, and 33 are similar to the power receiving cores 11 and 12 shown in FIG. 3. The respective intervals between the power receiving cores may be set arbitrarily similar to the interval between the power receiving cores 11 and 12, which is shown in FIG. 3. It is desirable that the intervals between the power receiving cores 31 and 32 and between the power receiving cores 32 and 33 are longer than the gap L5, in order to prevent the state where the voltage becomes low.

Power supply units 36 and 37 are respectively connected to power supply lines 34 and 35. Both of the power supply units 36 and 37 are similar to the power supply units 15 and 16 shown in FIG. 3. In the power receiving cores 31, 32, and 33, secondary coils 41, 42, and 43 respectively, are arranged in the direction where the magnetic flux of the respective power supply lines 34 and 35 is easiest to be obtained and in the neighborhood of the location where the magnetic flux is the strongest (the orientation of the secondary coils shown in FIG. 4 is an orientation for the sake of the convenience of illustration). The electric power obtained by each of the respective secondary coils 41, 42, and 43 is rectified into direct current by the respective rectifying elements 38, 39, and 40, and these DC powers are added and supplied to the driving part of the rail-guided vehicle.

The gap L5 in the second preferred embodiment is slightly longer (by several centimeters) than the length L6 in a similar manner as in the above described first preferred embodiment. Assuming that the rail-guided vehicle moves from the left to the right in FIG. 4, the maximum electric power is initially received from the power supply lines 34 when the total length of the power receiving cores 31, 32, and 33 are within the power supply lines 34. As the power receiving core 31, to which the electric power is supplied, moves into the gap L5, the amount of received power decreases. The power receiving core 31 then enters the state where no power is received when it is positioned between the power supply lines 34 and 35. Then, the power receiving core 31 begins to gradually receive the electric power from the power supply lines 35, and finally receives the maximum electric power from the power supply lines 35.

Similarly, after the power receiving core 32 receives the maximum electric power, the amount of received power decreases as the power receiving core 32 approaches the portion between the power supply lines 34 and 35 while the rail-guided vehicle is moving. The power receiving core 32 then enters the state where no power is received. Then, the amount of power received from the power supply lines 35 gradually increases. Finally, also the power receiving core 32 receives the maximum electric power supplied from the power supply lines 35.

The power receiving state of the power receiving core 33 changes in the same manner, and the power receiving core 33 finally receives the maximum electric power. The case where the voltages of the plurality of power receiving cores become low is similar to that of FIG. 3.

Figure 5:
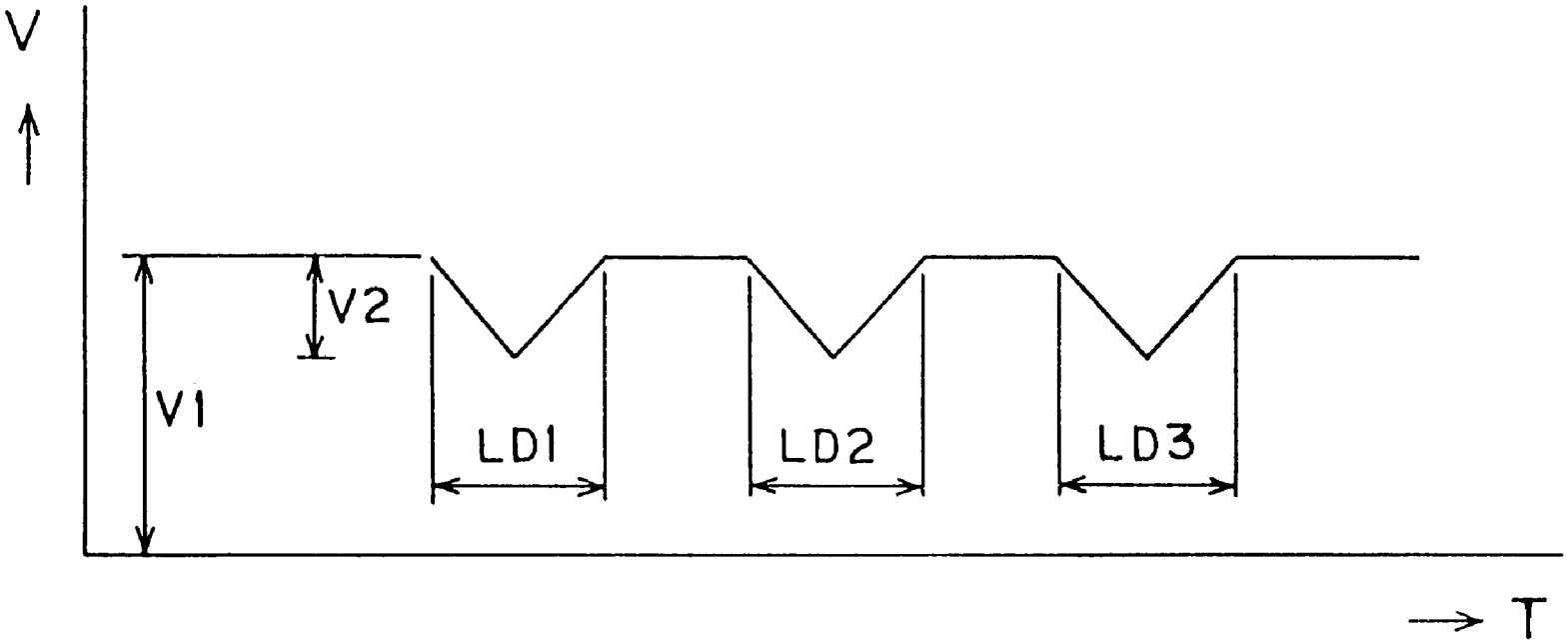
FIG. 5 shows the voltage level of the received electric power, which changes as a rail-guided vehicle moves, according to the second preferred embodiment shown in FIG. 3.

FIG. 5 shows the voltage of the electric power supplied to a rail-guided vehicle in the case where the rail-guided vehicle shown in FIG. 4, according to the second preferred embodiment, moves from the left to the right in FIG. 4, and where the respective arrangement intervals between the power receiving cores 31, 32, and 33 are longer than the gap L5 between the power supply lines 34 and 35.

The vertical axis shown in FIG. 5 indicates voltage. A voltage V1 indicates the maximum voltage obtained by adding the DC voltages output from the rectifying elements 38, 39, and 40. A voltage V2 indicates the value of the voltage which decreases when any of the power receiving cores 31, 32, and 33 is positioned at the location between the power supply lines 34 and 35 where no electric power is supplied, as shown in FIG. 4. The voltage V2 is approximately one third of the total voltage V1.

The horizontal axis shown in FIG. 5 indicates time. The voltage values when the power receiving cores 31, 32, and 33 pass through the location between the power supply lines 34 and 35 where no electric power is supplied are plotted on the horizontal axis. LD1 indicates the drop from the maximum voltage when the power receiving core 31 passes through the gap L5. LD2 indicates the drop from the maximum voltage when the power receiving core 32 passes through the gap L5. LD3 indicates the drop from the maximum voltage when the power receiving core 33 passes through the gap L5.

It becomes possible to reduce the ratio at which the total received voltage drops from one-half to one-third by increasing the number of power receiving cores from 2 to 3 as shown in FIG. 5. Similarly, it becomes possible to reduce the ratio of the drop of the total voltage from one-third to one-fourth by increasing the number of power receiving cores from 3 to 4.

This preferred embodiment refers to the cases where the number of power receiving cores is 2 and 3. However, the present invention is not limited to these implementations. The present invention may be applied also to the case where the number of power receiving cores attached to a rail-guided vehicle is equal to or larger than 4. Additionally, the number of rectifying elements arranged in the respective power receiving cores can be increased.

As described above, according to the present invention, it becomes possible to eliminate the influence caused by a difference between the phases or frequencies of power sources of a plurality of power supply lines in a non-contacting power supply system. Therefore, the numbers of times that a fault of a flatcar occurs or that the flatcar must be repaired can be reduced, thereby improving the running efficiency by decreasing the amount of time that the rail-guided vehicle is inoperative.

Additionally, according to the present invention, electric power can be supplied to an orbital flatbed in the locations where it passes between a plurality of power supply lines without being influenced by the differences in the frequency or phase of the original AC power. As a result, the driving device such as a motor of a rail-guided vehicle, etc., can stably run by being supplied with stable electric power.

Furthermore, according to the present invention, the ratio at which the supply voltage drops when a rail-guided vehicle passes through the locations between a plurality of power supply lines can be reduced, whereby the driving power of the rail-guided vehicle can be prevented from decreasing, and more stable running can be realized.

What is claimed is:

1. A non-contacting power supply system comprising:

a rail-guided vehicle mounted for traveling along a plurality of power supply lines connected to respective power sources;

the rail-guided vehicle including a plurality of power receiving cores for receiving a supply of electric power from the plurality of power supply lines; and wherein a gap between any pair of the plurality of power supply lines is equal to or longer than a length of at least one of said power receiving cores in a lingitudinal direction of one of said power supply lines.

2. The non-contacting power supply system according to claim 1, wherein:

respective rectifying elements are connected to the plurality of power receiving cores, and outputs from the respective rectifying elements are configures to power the rail-guided vehicle.

3. The non-contacting power supply system according to claim 1, wherein:

the number of the plurality of power receiving cores is equal to or larger than 3.

4. The non-contacting power supply system according to claim 2, wherein:

the number of the plurality of power receiving cores is equal to or larger than 3.

* * * * *

UNITED STATES PATENT AND TRADEMARK OFFICE

CERTIFICATE OF CORRECTION

PATENT NO. : 6,109,405
DATED : August 29, 2000
INVENTOR(S) : Yasuharu Odachi

It is certified that error appears in the above-identified patent and that said Letters Patent is hereby corrected as shown below:

Column 8,
Line 36, please change "lingitudinal" to -- longitudinal --;
Line 42, please change "configures" to -- configured --.

Signed and Sealed this

Twenty-sixth Day of March, 2002

*Attest:*

*Attesting Officer*

JAMES E. ROGAN
*Director of the United States Patent and Trademark Office*